US008004403B2

(12) United States Patent
McKethan

(10) Patent No.: US 8,004,403 B2
(45) **Date of Patent: *Aug. 23, 2011**

(54) SYSTEM AND METHOD FOR GENERATING AN ALERT FOR A TRAILER

(75) Inventor: John McKethan, Coppell, TX (US)

(73) Assignee: SkyBitz, Inc., Sterling, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/721,775

(22) Filed: Mar. 11, 2010

(65) Prior Publication Data

US 2010/0164700 A1 Jul. 1, 2010

(51) Int. Cl.
*G08B 1/08* (2006.01)

(52) U.S. Cl. ..... 340/539.23; 340/539.13; 340/539.15; 340/426.12; 340/426.19; 340/429; 340/686.6; 340/687; 701/300; 701/301; 701/302

(58) Field of Classification Search ..... 340/431, 340/687, 425.5, 686.6, 426.19, 539.13, 429, 340/426.12, 539.15, 539.23; 701/300–302
See application file for complete search history.

(56) References Cited

U.S. PATENT DOCUMENTS

| | | | | |
|---|---|---|---|---|
| 4,651,157 | A | 3/1987 | Gray et al. | |
| 5,621,417 | A | 4/1997 | Hassan et al. | |
| 5,640,139 | A | 6/1997 | Egeberg | |
| 6,542,076 | B1 | 4/2003 | Joao | |
| 6,687,609 | B2 | 2/2004 | Hsiao et al. | |
| 6,853,840 | B2 | 2/2005 | Najafi | |
| 6,919,803 | B2 * | 7/2005 | Breed | 340/539.14 |
| 7,138,916 | B2 | 11/2006 | Schwartz et al. | |
| 7,273,172 | B2 | 9/2007 | Olsen, III et al. | |
| 7,688,185 | B1 * | 3/2010 | McKethan | 340/431 |
| 2005/0192741 | A1 | 9/2005 | Nichols et al. | |
| 2006/0261935 | A1 | 11/2006 | McAden | |
| 2007/0018812 | A1 | 1/2007 | Allen et al. | |
| 2007/0241868 | A1 | 10/2007 | Fackrell et al. | |

* cited by examiner

*Primary Examiner* — Daniel Wu
*Assistant Examiner* — Ryan W Sherwin
(74) *Attorney, Agent, or Firm* — Duane S. Kobayashi

(57) ABSTRACT

A system and method for generating an alert signal for a trailer. Proper truck/trailer matching is based on a proximity analysis between position reports for a truck and position reports for a trailer. In one embodiment, this proximity analysis is triggered by a detection of movement in a trailer. In the proximity analysis, unexpected deviations in proximity between a truck and a trailer would lead to a generation of an alert signal that is sent to the appropriate management system for investigation.

15 Claims, 6 Drawing Sheets

SYSTEM AND METHOD FOR GENERATING AN ALERT FOR A TRAILER

This application claims priority to non-provisional application Ser. No. 11/606,298, filed Nov. 30, 2006, which is incorporated by reference herein, in its entirety, for all purposes.

BACKGROUND

1. Field of the Invention

The present invention relates generally to monitoring and tracking and, more particularly, to a system and method for verifying a trailer identification.

2. Introduction

Tracking mobile assets represents a growing enterprise as companies seek increased visibility into the status of movable assets (e.g., trailers, containers, etc.). Visibility into the status of movable assets can be gained through mobile terminals that are affixed to the assets. These mobile terminals can be designed to generate position information that can be used to update status reports that are provided to customer representatives.

One of the challenges in tracking assets is the coordination of movement of those assets. Information about the location of a particular asset is a key piece of information when considering the status of the asset on route to a scheduled destination. In and of itself, however, the location of a particular asset does not provide any assurance that the asset is on its way to its scheduled destination. For example, the asset could be on its way to a wrong destination. What is needed therefore is a system and method for monitoring and coordinating the movement of assets.

SUMMARY

A system and/or method for generating an alert for a trailer, substantially as shown in and/or described in connection with at least one of the figures, as set forth more completely in the claims.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Figure 1:
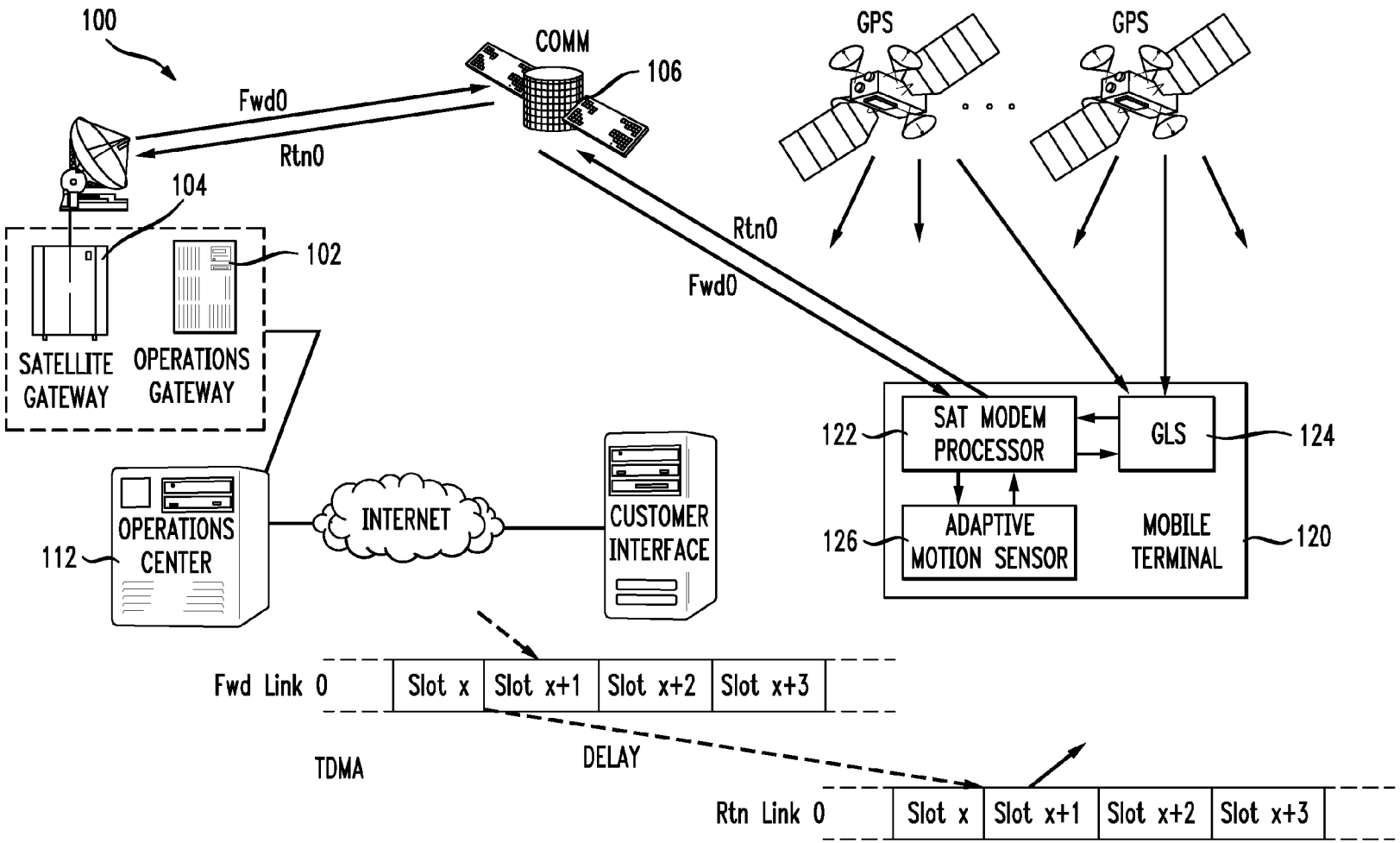
FIG. 1 illustrates an embodiment of a satellite network in communication with a mobile terminal.

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

Asset transport systems face many challenges in the scheduling and monitoring of the movement of assets. Where assets are individually moved by a transport vehicle such as a truck, it is critical that the appropriate scheduling and dispatch processes are properly managed to ensure that assets reach their intended destinations.

In the truck/trailer asset transport environment, a graphical user interface screen presented by customer dispatch software can be used by the customer to specify an order for transport of a load from a pickup location to an intended destination. This order can specify a specific load status (e.g., high priority, hazmat, expedited, etc.) along with a pickup and delivery time. The load is then matched to a power unit (e.g., truck) and trailer, and dispatched to the driver. The driver receives the order information and would then proceed with the truck to pick up the trailer that carries the load. The particular trailer specified in the order is identified based on a trailer ID. After the driver arrives at the customer site, the driver (or driver manager) would confirm the driver's arrival to pickup the load. When the load arrives at it's destination, the driver would then send an arrival notification over an in-cab mobile communication system.

In this process, it is critical that the truck and trailer are properly matched. For example, if an error occurs at trailer pickup, then the wrong load will be delivered to the destination location. In another example, the wrong trailer pickup (e.g., empty chemical tanker) would lead to an inability to pickup a certain type of load. In general, while the route traveled by a trailer can be monitored with respect to an expected travel route to detect unexpected deviations, it does not assure that the right trailer has been picked up. Moreover, route monitoring analysis is complex and may require significant interaction and coordination between dispatch software and the tracking system.

In accordance with the present invention, truck/trailer matching is based on a proximity analysis between a position report for a truck and a position report for a trailer. In this proximity analysis, unexpected deviations in proximity would lead to an inference that a truck and a trailer are mismatched, that a trailer has been stolen, or that some other unintended or unauthorized movement of the trailer has occurred. An indication of such a mismatch can lead to the generation of an alert signal that would be sent to the appropriate management system for investigation.

It is a feature of the present invention that the proximity analysis is driven by detection of movement by a motion sensor. Use of a motion sensor system is particularly advantageous since motion-activated position events correlate more highly with a trailer pickup as compared to conventional periodic position reports. This ensures that the proximity analysis would be performed only when necessary, thereby obviating the need for comprehensive and continual analysis of proper truck/trailer matching.

In one embodiment, the motion sensor is an independent processing unit within a mobile terminal that detects different levels of vibration. In one embodiment, three valid states can be defined: (1) no vibration where the engine is off and no movement; (2) engine on but no movement; and (3) engine on and movement. Determining a level of vibration will therefore enable an identification of an operating state.

In one embodiment, a proximity analysis is initiated based on a detection of a start event that correlates with a trailer starting to move. When the trailer does start to move, the position of the trailer changes. As will be described in greater detail below, the position reports that track these changes are used in the proximity analysis.

Prior to describing the details of the proximity analysis, a description of an embodiment of an operational context is first provided. FIG. 1 illustrates an embodiment of a satellite network that includes operations gateway 102, communicating with satellite gateway 104, and has one forward and one return link (frequency) over satellite 106 to mobile terminal 120 located on the asset (e.g., trailer). The satellite waveform is implemented in the Time Division Multiple Access (TDMA) structure, which consists of 57600 time slots each day, per frequency or link, where each slot is 1.5 seconds long. On the forward link, operations gateway 102 sends a message or packet to mobile terminal 120 on one of the 1.5 second slots to give instructions to global locating system (GLS) component 124 via satellite modem processor 122. One example is to instruct GLS component 124 to perform a Global Positioning System (GPS) collection (e.g., code phase measurements) and transmit the data back to operations gateway 102. When GLS component 124 of mobile terminal 120 receives this forward command, it collects the GPS information and transmits the data back on the return link, on the same slot, delayed by a fixed time defined by the network. The delay is needed to decode the forward packet, perform the GPS collect and processing, and build and transmit the return packet.

From there, operations gateway 102 passes the information to operation center 112, where the information is used to solve for position and present the position information to the customer via the internet. A detailed description of this process is provided in U.S. Pat. No. 6,725,158, entitled "System and Method for Fast Acquisition Position Reporting Using Communication Satellite Range Measurement," which is incorporated herein by reference in its entirety.

It should be noted that the principles of the present invention can also be applied to other satellite-based or terrestrial-based location determination systems where the position is determined at the mobile terminal independently, or at the mobile terminal in combination with information received from another location.

As illustrated in FIG. 1, mobile terminal 120 also includes adaptive motion sensor 126. A detailed description of an adaptive motion sensor is provided in co-pending U.S. patent application Ser. No. 11/377,653, filed Mar. 17, 2006, entitled "System and Method for Adaptive Motion Sensing with Location Determination," which is incorporated herein by reference in its entirety. The main task of adaptive motion sensor 126 is to determine whether an asset is moving or not. From there, together with the mobile terminal processor (not shown) and GLS component 124 it can determine the arrival and departure times and locations of an asset. When an asset begins to move, the adaptive motion sensor 126 detects the motion or vibration and sends a signal to the mobile terminal processor informing it that motion has started. The mobile terminal processor then records the time motion started, and signals to GLS component 124 to collect code phase. The start time and the codephase are sent over the satellite back to operations gateway 102 and operation center 112 where the codephase is used to solve for position, and the start time is used to generate the departure time. Conversely, when adaptive motion sensor 126 determines motion has stopped it will again inform the mobile terminal processor to collect time and codephase, and send the information back to operations gateway 102. Operation center 112 solves for position, and the stop time is used to generate the arrival time. The arrival and departure times along with their locations can be supplied to the user via the Internet. As noted, in an alternative embodiment, the mobile terminal could send a position determined at the mobile terminal back to operations center 112.

In one embodiment, adaptive motion sensor 126 has a layer of filtering that is capable of filtering out unwanted starts and stops and only transmits true arrival and departure information. Adaptive motion sensor 126 can be configured to only transmit starts or stops when the change in motion is maintained for a configurable percentage of time. In this manner, only accurate arrival and departure time information is transmitted using the mobile terminal with the adaptive motion sensor. This layer of filtering saves on unwanted transmissions, and hence power, bandwidth, and cost.

In one embodiment, mobile terminal 120 is configured to transmit a position report after the actual arrival or departure times when the motion sensor has reached its "no-motion" or "motion" times, respectively. The "motion" and "no-motion" times can be separately configurable, for example, from one minute up to two hours. This configurability can be used to allow more time to exit an area of interest, or allow more time at rest stops along the way.

In one embodiment, the user-configurable "motion sensitivity" can be implemented as the percentage of time the asset needs to remain in motion during the "motion time" to signal motion. This is useful, for example, in maintaining a motion condition while stopped at a traffic light or a rest stop. Conversely, the user-configurable "no-motion sensitivity" can be implemented as the percentage of time the asset needs to remain in no-motion during the "no-motion" time to signal no-motion. This is useful, for example, in maintaining a no-motion condition while moving a trailer within a yard.

Figure 2A:
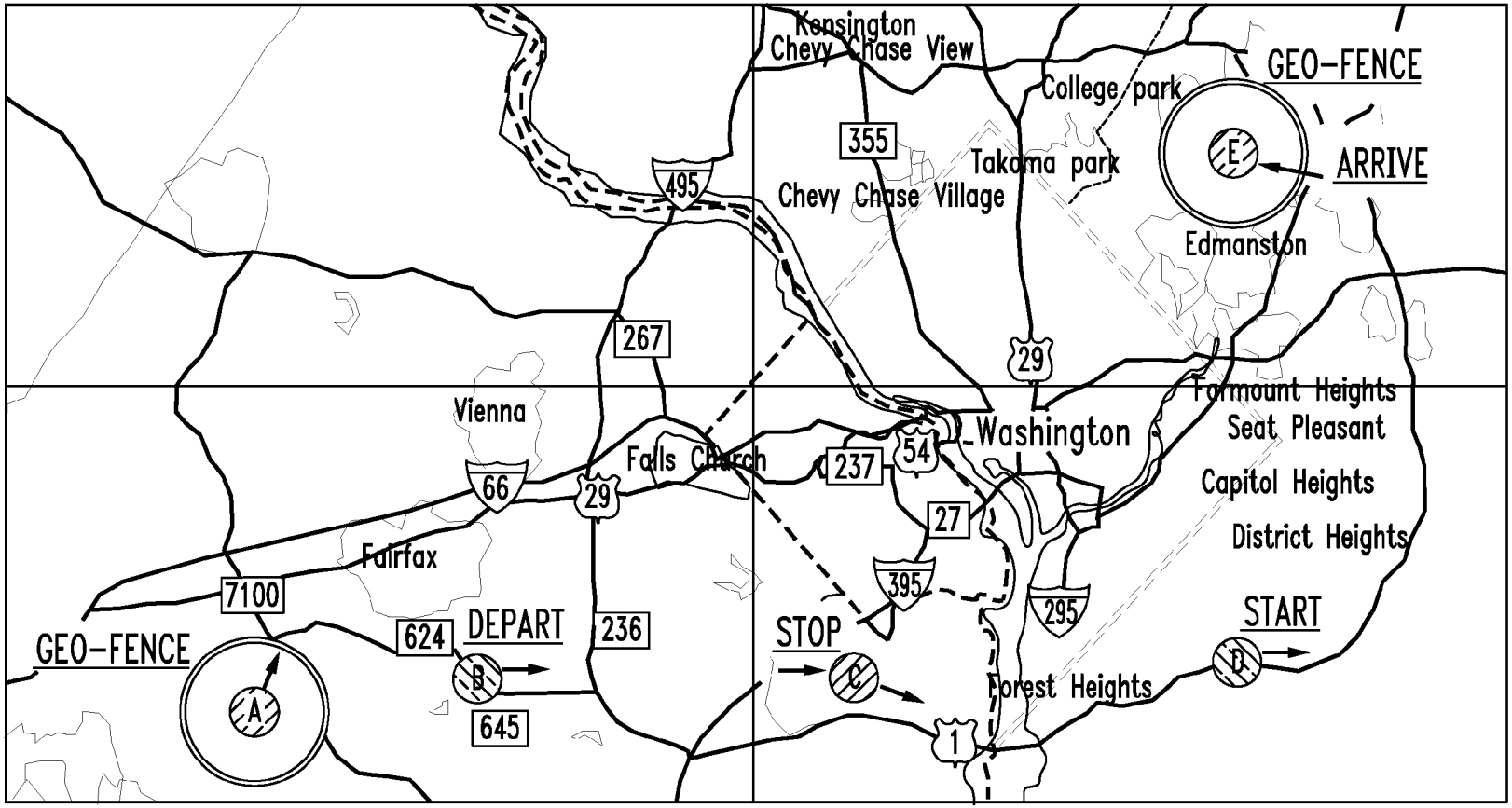
FIGS. 2A and 2B illustrate an example of a timeline of status reports generated by a moving asset.
Figure 2B:
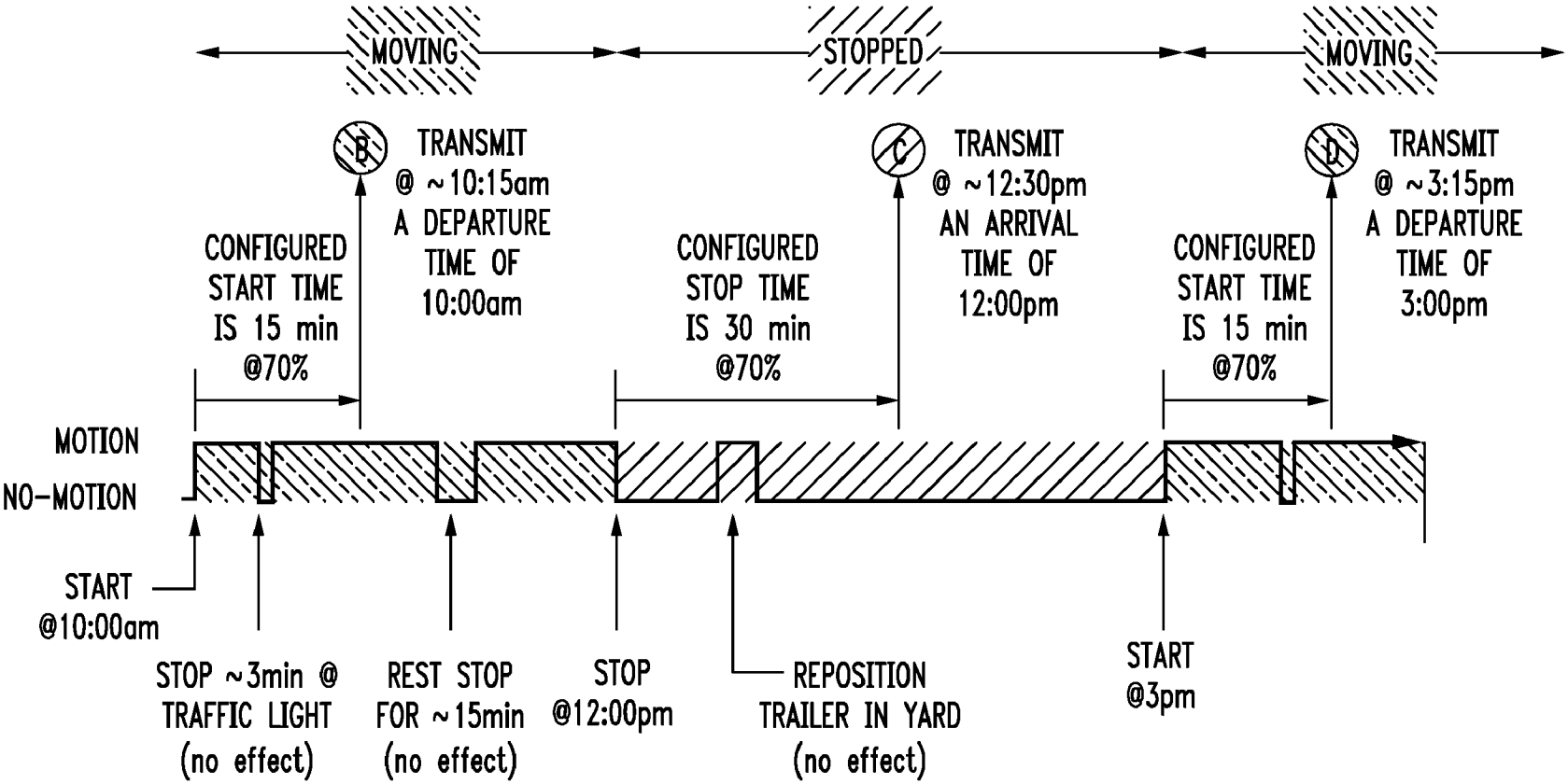

FIGS. 2A and 2B illustrate an example of a timeline of a unit moving from point A to point E, and stopping in between. In this example, two states are used for the adaptive motion sensor: motion and no-motion. The user-configurable motion time is set at 15 minutes, while the user-configurable motion sensitivity is set at 70%. The user-configurable no-motion time is set at 30 minutes, while the user-configurable no-motion sensitivity is set at 70%.

The timeline begins at 10 AM when the asset begins to leave a yard at point A on its trip to point E. When the adaptive motion sensor determines a transition to the motion state, it records the time of 10 AM. The asset then stops at a traffic light between point A and point B for three minutes. During this time, the adaptive motion sensor determines that the asset is in a no-motion condition for those three minutes. It should be noted that even with the existence of the motion condition prior to the traffic light stop, the mobile terminal does not report that the asset has departed point A. This results because the user-configurable motion time has been set at 15 minutes. Thus, the motion time threshold has not yet been reached. When the 15-minute motion time has expired, the mobile terminal then determines whether the user-configurable motion sensitivity has been satisfied. With a motion sensitivity of 70%, the asset would need to maintain a motion condition for at least 70% of the 15 minutes, or 10.5 minutes. In this example, the asset has maintained a motion condition for 12 of the 15 minutes, therefore satisfying the motion sensitivity threshold. With both the time and sensitivity thresholds being met, the mobile terminal then transmits a message to the operations center that the asset has departed point A at 10 AM. The time of transmission is illustrated as point B. Here, it should be noted that the time reported (i.e., 10 AM) is not the same as the time of the report (i.e., 10:15 AM).

After the transmission at point B, the asset stops at a rest stop for 15 minutes. This 15-minute stop does not trigger an arrival message because it has not met the user-configurable no-motion time and sensitivity parameters of 30 minutes and 70%, respectively. Specifically, the 15-minute stop has not met the 21-minute (i.e., 70% of 30 minutes) threshold dictated by the user-configurable no-motion parameters.

At 12 AM the asset stops at point C in a yard. Even with the repositioning of the asset within the yard for about 5 minutes, the adaptive motion sensor determines that the asset has maintained a no-motion condition for more than 70% of the 30 minutes. At the expiration of the no-motion time, the mobile terminal then transmits a message at 12:30 AM indicating that the asset had stopped at 12 AM.

At 3 PM, the adaptive motion sensor determines that the asset has entered a motion condition as the asset resumes its journey. At 3:15 PM, the user-configurable motion time and sensitivity parameters are met and the mobile terminal then transmits a message at 3:15 PM indicating that the asset has departed at 3 PM.

This process continues as the asset continues on to point E. Throughout this process, the mobile terminal transmits start and stop messages only when the user-configurable time and sensitivity parameters are met. In one embodiment, the mobile terminal can also be configured to periodically transmit status reports (e.g., once per hour) when in a motion condition. These periodic status reports would enable the system to track the asset while en route.

Arrival times, departures times, and code phase collections are initiated by the adaptive motion sensor when the asset starts and stops moving. In one embodiment, detection of when an asset starts and stops moving is based on the change in measurable vibration on the asset that is caused when an asset starts or stops moving. The adaptive motion sensor can therefore be designed to measure the amount of vibration or acceleration to determine movement.

Figure 3:
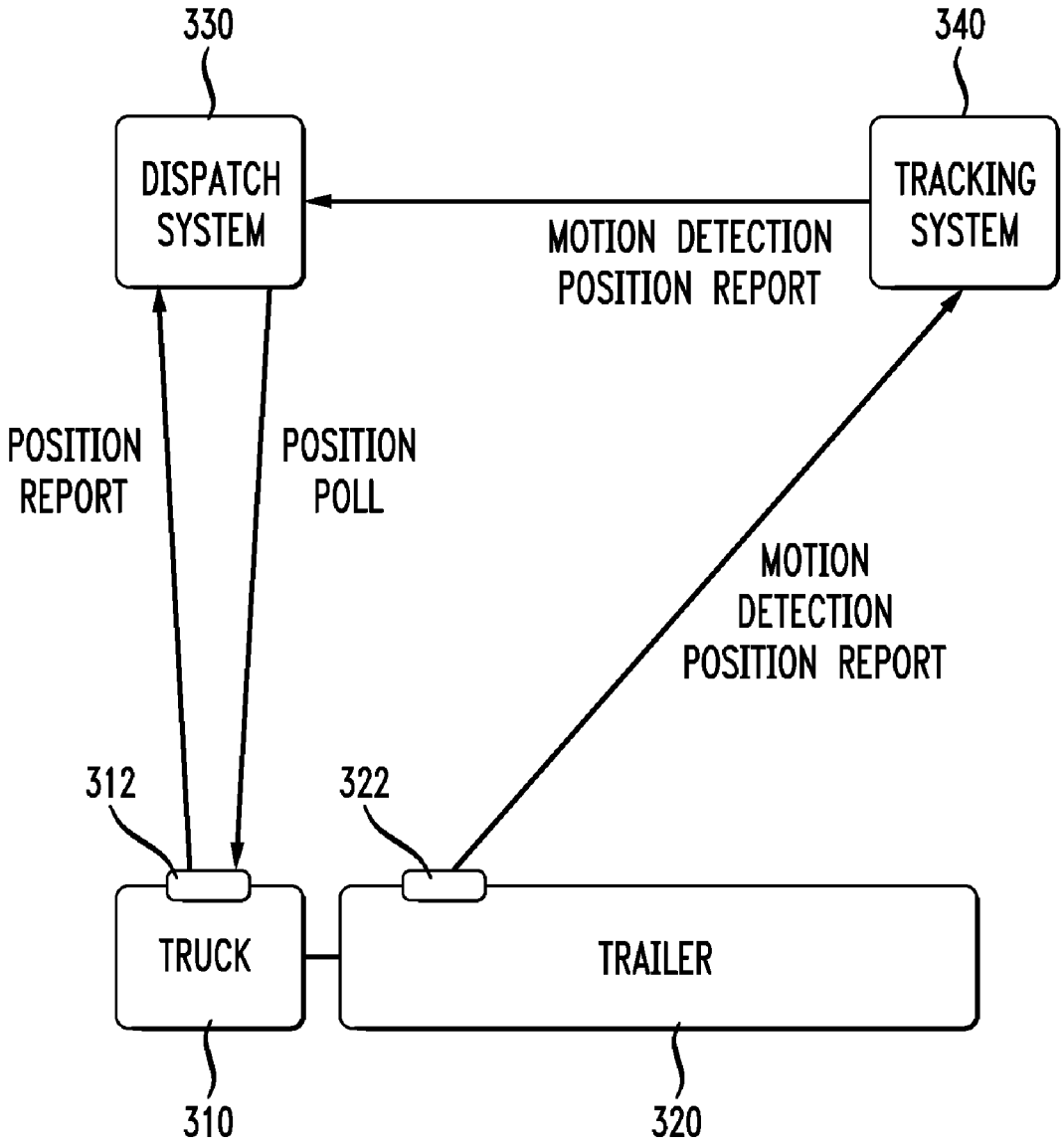
FIG. 3 illustrates system elements that collaborate in obtaining position data used in a proximity analysis.

As noted, position reports such as that generated when an asset starts moving can be used to initiate a proximity analysis between a truck and a trailer. The results of such a proximity analysis are used to determine whether a truck is properly matched to the trailer that it is hauling. To illustrate the use of a proximity analysis in this determination, reference is now made to FIGS. 3 and 4. FIG. 3 illustrates those system elements that collaborate in obtaining position data used in the proximity analysis, while FIG. 4 illustrates an embodiment of a process of interaction between those system elements.

As illustrated in FIG. 3, a truck 310 is coupled to trailer 320 that carries a load. Affixed to trailer 320 is a mobile terminal 322 that is operable to perform those functions described above in forwarding position reports to tracking system 340. Affixed to truck 310 is an in-cab mobile communication system 312 that can include such features as two-way text and data communication with dispatch system 330. Mobile communication system 312 can also forward position information obtained via automatic satellite vehicle positioning. An example of such an in-cab mobile communication system is QUALCOMM'S OMNITRACS® mobile communication solution.

Figure 4:
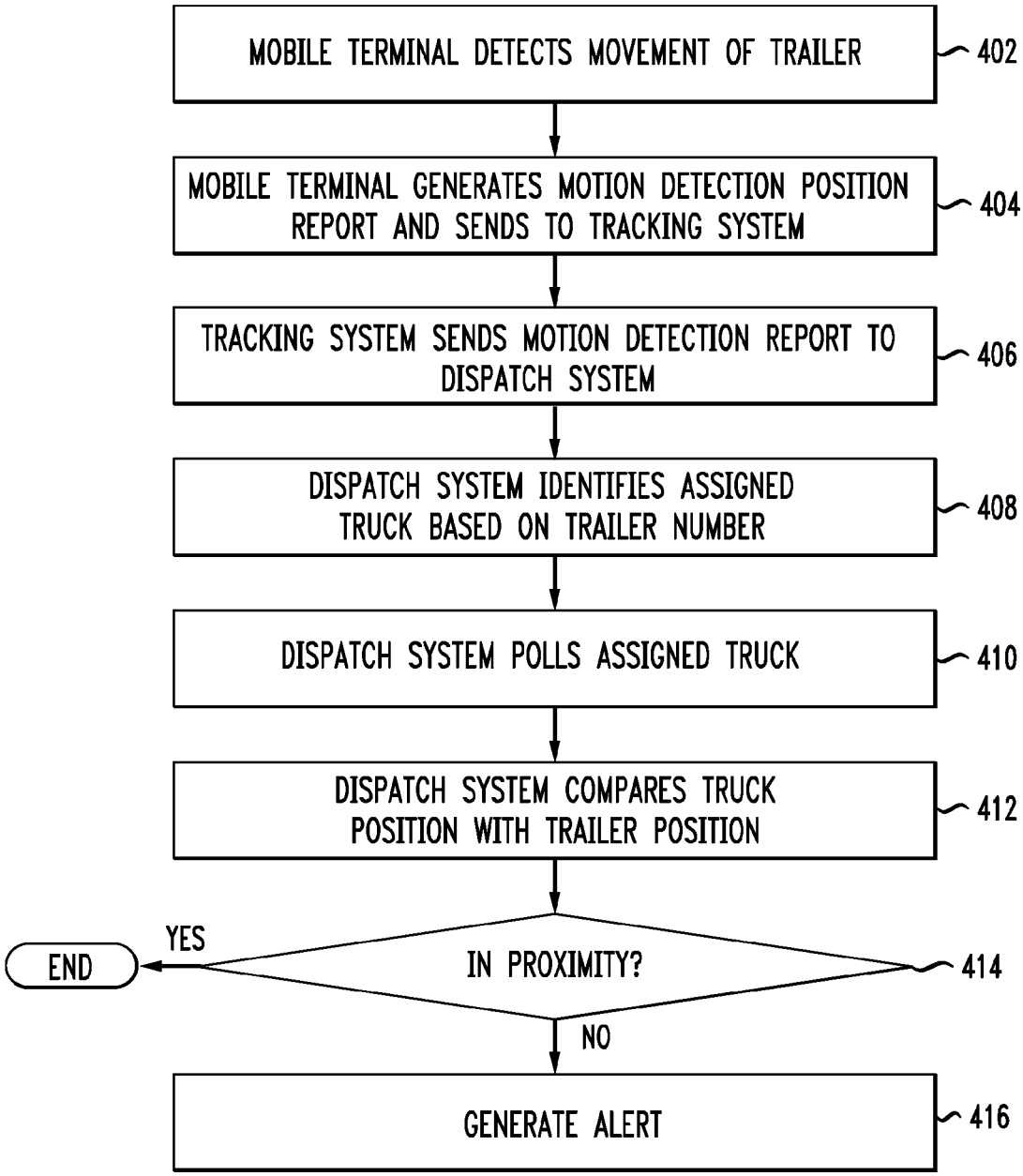
FIG. 4 illustrates a flowchart of a process of the present invention.

Interaction of the elements of FIG. 3 are now described in the flowchart of FIG. 4, which begins after truck 310 is coupled to trailer 320. As illustrated, the process begins at step 402 where mobile terminal 322 detects movement of trailer 320. As described above, movement of trailer 320 can be detected using a mobile terminal that includes a motion sensor. Next, at step 404, after movement of trailer 320 is detected, mobile terminal 322 would then generate a motion detection position report and send the motion detection position report to tracking system 340. This motion detection position report can be sent at a configurable amount of time (e.g., 10 minutes) after movement of trailer 320 is first detected. In one embodiment, the motion detection position report includes the time motion started and position information, which can be generated at any point in time during the configurable amount of time. If the position information is generated at a point later than the time motion started (e.g., at the end of the configurable time period), then the time at which the position information is generated can also be sent in the motion detection position report.

At step 406, tracking system 340 sends a motion detection report to dispatch system 330 that alerts dispatch system 330 that trailer 320 is moving. Next, at step 408, dispatch system 330 identifies the truck that is assigned to the trailer identified by the trailer ID included in the motion detection report. At step 410, dispatch system 330 then polls the assigned truck for a position report. It should be noted that the truck's in-cab mobile communication system can also be designed to report positions periodically (e.g., hourly) in addition to responses to polling requests. If the periodic position report is determined to be recent enough, then the assigned truck may not need to be polled. At step 412, after the position report (either periodic or in response to a poll) is received from the assigned truck, the customer compares the truck position with the trailer position.

At step 414, a proximity analysis is performed to determine whether truck 310 is in proximity to trailer 320. If the proximity analysis of step 414 indicates that truck 310 is in proximity to trailer 320, then the process ends as the truck is properly matched to the trailer. Alternatively, if the proximity analysis of step 414 indicates that truck 310 is not in proximity to trailer 320 then an alert is generated at step 416. In general, this alert would signal that the truck that is assigned to trailer 320 has not picked up trailer 320, indicating that the wrong truck is now coupled to trailer 320. The appropriate steps would then be taken by the management system to address the trailer/truck mismatch.

Figure 5:
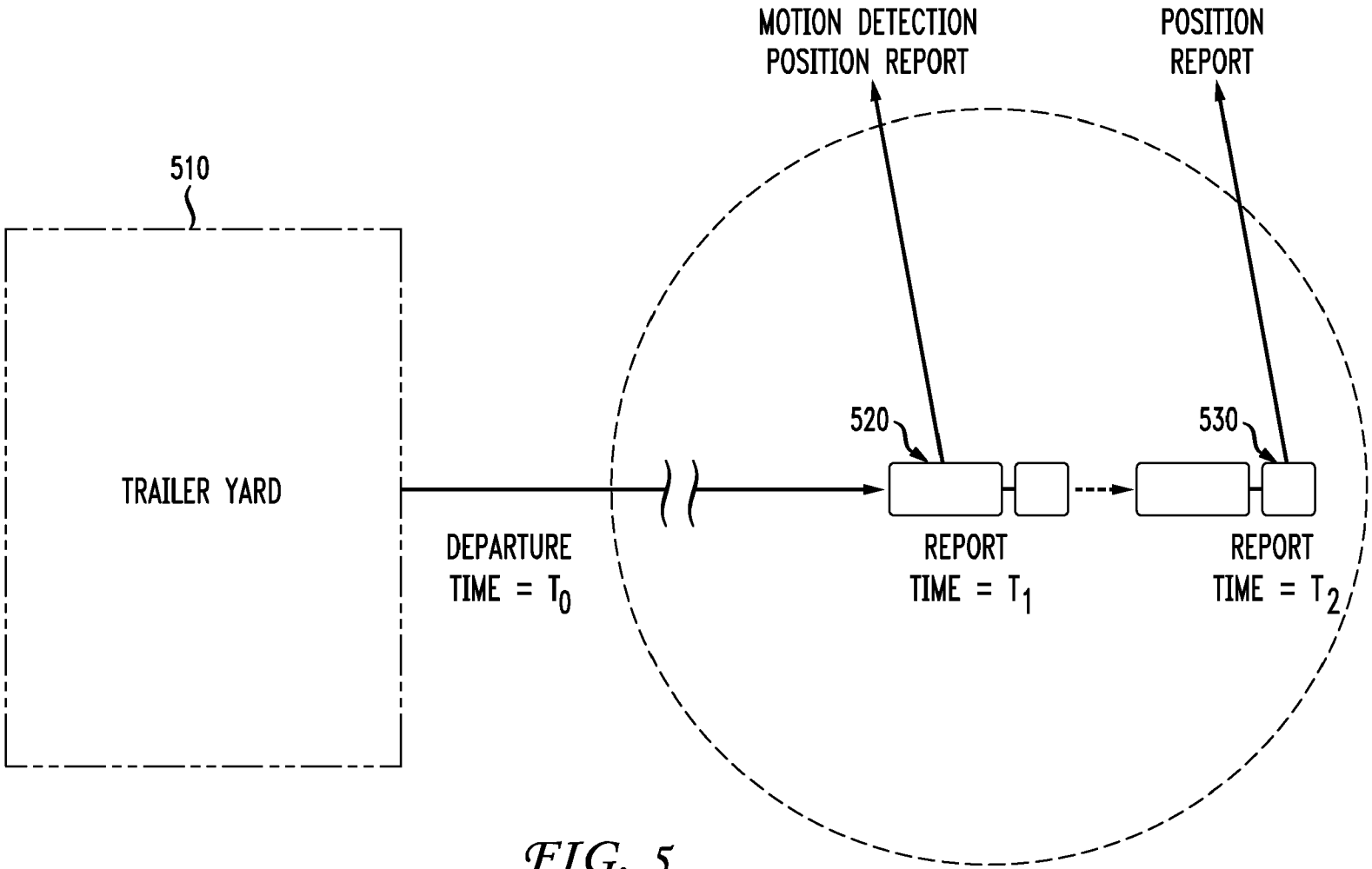
FIG. 5 illustrates an example of trailer and truck communication times.

In one embodiment, the proximity analysis is based simply on the distance between the two position reports. In another embodiment, the proximity analysis includes consideration of other variables beyond the two position reports. To illustrate an example of additional variables that can be used in the proximity analysis consider the illustration of FIG. 5.

In this illustration, trailer 520 leaves trailer yard 510 at time $T_0$ under the control of truck 530. At time $T_1$, the mobile terminal affixed to trailer 520 sends a motion detection position report to the tracking system. In this illustration, it is assumed that the position information contained in the motion detection position report was obtained at a time proximate to the time $T_1$. As noted above, however, the position information can be obtained any time prior to the report time $T_1$, even back to the departure time $T_0$.

After the dispatch system is alerted and the dispatch system polls truck 530, truck 530 responds with the position report at time $T_2$. As would be appreciated, the time difference between time $T_1$ and time $T_2$ can range from less than a minute to multiple minutes depending on latencies built into the communication system protocol. This difference in time is reflected in the difference in the reported positions of trailer 520 and truck 530, assuming that they are traveling together. For example, if the elapsed time between $T_1$ and time $T_2$ is two minutes, then the difference in position between trailer 520 and truck 530 can be approximately two miles. For this reason, the proximity analysis can be designed to analyze the difference in position using a proximity radius that would encompass an allowable magnitude difference in position based on assumed system delays. This proximity radius can be user configurable (e.g., 500 feet, 10 miles, etc.).

In general, the proximity analysis is designed to increase the probability of detection of a truck and a trailer that are traveling together. In this analysis, the likelihood of detection would be influenced by a number of factors. As noted above, one factor can be based on the expected difference in positions reported for the trailer and the truck. In the above illustration, it was assumed that the trailer position report occurred proximate to the time of transmission at time $T_1$. This may not be the case, however. The position information may have been obtained five minutes before time $T_1$. In this case, the expected difference the trailer position and the truck position would be even greater. The proximity radius may therefore need to be increased.

Another factor that can be considered is the distance from the start position (i.e., trailer yard). In general, the further away the trailer is from the trailer yard, the less likely the proximity analysis would lead to a false detection. This results since many trucks and trailers may be resident at the trailer yard, such that there is a greater likelihood that a truck not traveling with the trailer would fall within the proximity radius. For this reason, the proximity analysis can also consider the distance from the start (or time from departure) in its calculation. For example, a trailer that is 60 miles from the departure point can use a larger proximity radius as compared to a trailer that is 10 miles from the departure point. It should be noted, however, that while the probability of correct detection increases as the distance from the starting point increases, the penalty for having a mismatched truck and trailer also increases. This penalty is reflected in the amount of time it takes to have the mismatched truck and trailer situation corrected.

As has been described, a system and method of generating an alert signal for a truck and trailer mismatch can be initiated upon the detection of movement in a trailer. This detection of movement would trigger the polling of a truck that has been assigned to the trailer. The return of position information by the truck would then enable a proximity analysis that analyzes a reported position of the truck to a reported position of the trailer. The results of such a proximity analysis is then used to determine whether an alert signal should be generated. It should be noted that the proximity analysis can be performed by any system element that has access to the position information of both the truck and the trailer. It should also be noted that the proximity analysis can be used to confirm that a truck and trailer have been separated, for example, after a trailer drop off should have occurred. In this scenario, the proximity analysis can be designed to generate an alert signal if the truck and the trailer are within a specified proximity, which would indicate that the truck and trailer are still attached.

These and other aspects of the present invention will become apparent to those skilled in the art by a review of the preceding detailed description. Although a number of salient features of the present invention have been described above, the invention is capable of other embodiments and of being practiced and carried out in various ways that would be apparent to one of ordinary skill in the art after reading the disclosed invention, therefore the above description should not be considered to be exclusive of these other embodiments. Also, it is to be understood that the phraseology and terminology employed herein are for the purposes of description and should not be regarded as limiting.

What is claimed is:

1. A system for generating an alert for an asset being transported, comprising:

a polling system that polls an asset transporter for a position;

a tracking system that receives a motion detection report from a mobile terminal affixed to said asset, wherein said tracking system alerts said polling system of motion of said asset, to initiate a polling of said asset transporter by said polling system; and a proximity analysis system that determines whether a reported position of said asset transporter in response to a poll is in proximity to a reported position of said asset, said reported position of said asset being determined based on a satellite communication received from said mobile terminal, wherein if said reported position of said asset transporter is determined not to be in proximity to said reported position of said asset, said proximity analysis system generates an alert.

2. The system of claim 1, wherein said proximity analysis system determines said proximity based on a measure of time.

3. The system of claim 1, wherein said proximity analysis system determines said proximity based on a measure of distance.

4. The system of claim 1, wherein said tracking system receives said motion detection position report from said mobile terminal via a communication satellite.

5. A method of generating an alert for an asset, comprising:

receiving, via a communication satellite, a motion detection report from a mobile terminal affixed to said asset, said motion detection report including information that enables identification of a position of said asset;

requesting, in response to said received motion detection report, a position report from an asset transporter that has been identified as being assigned to transport said asset;

determining whether a reported position of said identified asset transporter, which is received in response to said request, is in proximity to said identification of said position of said asset; and generating an alert if it is determined that said reported position of said identified asset transporter is not in proximity to said identified position of said asset.

6. The method of claim 5, wherein said receiving comprises receiving a motion detection report that is generated based on a motion sensor condition.

7. The method of claim 5, wherein said requesting comprising polling said asset transporter by a dispatch system.

8. The method of claim 5, wherein said determining is based on a time elapsed from a time of departure of said trailer from an origin location.

9. The method of claim 5, wherein said determining is based on a proximity radius from said reported position of said asset transporter.

10. The method of claim 5, wherein said determining is based on a distance of said reported position of said asset transporter from an origin location.

11. The method of claim 5, wherein said determining is based on a difference in time between a time of said identified position of said asset and a time of said reported position of said asset transporter.

12. A method of generating an alert for an asset being transported by an asset transporter, comprising:

receiving, via a satellite communication network, a motion detection report that indicates that an asset has moved, said motion detection report being generated based on a reading of a sensor attached to said asset;

identifying a position of an asset transporter that has been assigned to transport said asset, said identification being based on a position request that is transmitted in response to said received motion detection report;

determining whether said identified position of said asset transporter is in proximity to a position of said asset, said position of said asset being determined from position information contained in said received motion detection report; and generating an alert if said identified position of said asset transporter is not in proximity to said determined position of said asset.

13. The method of claim 12, wherein said identifying comprises polling said asset transporter via a dispatch system.

14. The method of claim 12, wherein said determining is based on a measure of time.

15. The method of claim 12, wherein said determining is based on a measure of distance.

* * * * *